US006148938A

United States Patent [19]

Beaton

[11] Patent Number: 6,148,938

[45] Date of Patent: Nov. 21, 2000

[54] WEAR RESISTANT CUTTER INSERT STRUCTURE AND METHOD

[75] Inventor: Michael S. Beaton, The Woodlands, Tex.

[73] Assignee: Dresser Industries, Inc., Dallas, Tex.

[21] Appl. No.: 09/175,906

[22] Filed: Oct. 20, 1998

[51] Int. Cl.[7] ..... E21B 10/36

[52] U.S. Cl. ..... 175/432; 175/426; 175/428; 175/434; 51/293; 51/295

[58] Field of Search ..... 175/434, 374, 175/426, 432, 428; 51/293, 295, 297

[56] References Cited

U.S. PATENT DOCUMENTS

| | | | |
|---|---|---|---|
| 2,066,853 | 1/1937 | Rea | 148/21.7 |
| 4,109,737 | 8/1978 | Bovenkerk | 175/329 |
| 4,629,373 | 12/1986 | Hall | 175/434 X |
| 4,716,975 | 1/1988 | Dennis | 175/329 |
| 4,764,434 | 8/1988 | Aronsson et al. | 428/565 |
| 4,784,023 | 11/1988 | Dennis | 76/108 A |
| 4,984,642 | 1/1991 | Renard et al. | 175/329 |
| 5,007,207 | 4/1991 | Phaal | 51/204 |
| 5,037,451 | 8/1991 | Burnand et al. | 51/293 |
| 5,120,327 | 6/1992 | Dennis | 51/293 |
| 5,161,335 | 11/1992 | Tank | 51/204 |
| 5,335,738 | 8/1994 | Waldenström et al. | 175/420.2 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,469,927 | 11/1995 | Griffin | 175/432 |
| 5,472,376 | 12/1995 | Olmstead et al. | 451/540 |
| 5,484,330 | 1/1996 | Flood et al. | 451/540 |
| 5,486,137 | 1/1996 | Flood et al. | 451/540 |
| 5,494,477 | 2/1996 | Flood et al. | 451/540 |
| 5,499,688 | 3/1996 | Dennis | 175/426 |
| 5,524,719 | 6/1996 | Dennis | 175/432 |
| 5,544,713 | 8/1996 | Dennis | 175/434 |
| 5,564,511 | 10/1996 | Frushour | 51/293 X |
| 5,566,779 | 10/1996 | Dennis | 175/426 |
| 5,598,750 | 2/1997 | Griffin et al. | 76/108.2 |
| 5,605,198 | 2/1997 | Tibbitts et al. | 175/432 |
| 5,611,649 | 3/1997 | Matthias | 407/118 |
| 5,622,233 | 4/1997 | Griffin | 175/432 |
| 5,630,479 | 5/1997 | Dennis | 175/426 |
| 5,662,720 | 9/1997 | O'Tighearnaigh | 51/295 |
| 5,669,271 | 9/1997 | Griffin et al. | 76/108.2 |
| 5,709,279 | 1/1998 | Dennis | 175/432 X |
| 5,758,733 | 6/1998 | Scott et al. | 175/432 |
| 5,788,001 | 8/1998 | Matthias et al. | 175/432 |
| 5,862,873 | 1/1999 | Matthias et al. | 175/432 |
| 5,906,246 | 5/1999 | Mensa-Wilmot et al. | 175/432 |

*Primary Examiner*—Eileen D. Lillis
*Assistant Examiner*—Jong-Suk Lee
*Attorney, Agent, or Firm*—Groover & Associates PC; Robert Groover; Betty Formby

[57] ABSTRACT

A wear resistant cutter insert structure and method include a stud having at least one face. A primary tapered ridge and at least one secondary tapered ridge extending from the primary tapered ridge are formed in the face. A layer of abrasive material is disposed over the face covering the primary and secondary tapered ridges.

15 Claims, 3 Drawing Sheets

WEAR RESISTANT CUTTER INSERT STRUCTURE AND METHOD

TECHNICAL FIELD OF THE INVENTION

This invention relates generally to the art of earth boring and, more particularly, to a wear resistant cutter insert structure and method.

BACKGROUND OF THE INVENTION

An example of a drill bit used for drilling earth bore holes for the exploration and production of oil and gas and the like is a roller cone rock bit. This type of bit employs a multiplicity of rolling cone cutters, also known as rotary cone cutters, rotatably mounted on bearing pins extending from arms of the bit. The cutters are mounted on pins that extend downwardly and inwardly with respect to an axis through the bit axis so that conical sides of the cutters tend to roll on the bottom of a bore hole and contact an earth formation. A number of insert bits or compacts are disposed in the rolling cone cutters to drill the formations at the bottom of the bore hole. These insert bits tend to wear in those areas that engage the bottom and peripheral wall of the bore hole during the drilling operation.

Each insert bit may include a superhard abrasive material bonded to a stud. Abrasive materials such as synthetic or natural diamond, cubic boron nitride, and wurtzite boron nitride are bonded to the stud to increase wear resistance of the insert bit. The abrasive material is often referred to as polycrystalline diamond, PDC, or sintered diamond. The stud may be comprised of a substrate material such as tungsten carbide. One of the factors limiting the wear resistance of the insert bit is the strength of the bond between the polycrystalline diamond and the stud. A weak bond results in decreased wear resistance and premature insert bit failure.

SUMMARY OF THE INVENTION

Accordingly, a need has arisen for an improved wear resistant cutter insert structure and method that provides improved wear resistance.

In accordance with the teachings of the present invention, a wear resistant cutter insert structure and method are provided that address disadvantages and problems associated with prior art cutter insert structures and methods. According to one embodiment of the present invention, a cutter insert for a roller cone rock bit includes a stud having at least one face. The face has a primary tapered ridge and at least one secondary tapered ridge extending from the primary tapered ridge. A layer of abrasive material is disposed over the face and the primary and secondary tapered ridges.

According to another embodiment of the invention, a method for fabricating a cutter insert for a roller cone rock bit includes providing a stud having at least one face. The face has a primary tapered ridge and at least one secondary tapered ridge extending from the primary tapered ridge. The method also includes applying a layer of abrasive material over the face and the primary and secondary tapered ridges.

The invention provides several technical advantages. For example, the invention provides a cutter insert for a roller cone rock bit with increased wear resistance. In one embodiment of the invention, the cutter insert reduces the risk of polycrystalline diamond delamination over conventional cutter inserts by decreasing interfacial shear stresses between the polycrystalline diamond and the stud. Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Embodiments of the present invention and its advantages are best understood by referring to FIGS. 1 through 5 of the drawings, like numerals being used for like and corresponding parts of the various drawings.

Figure 1:
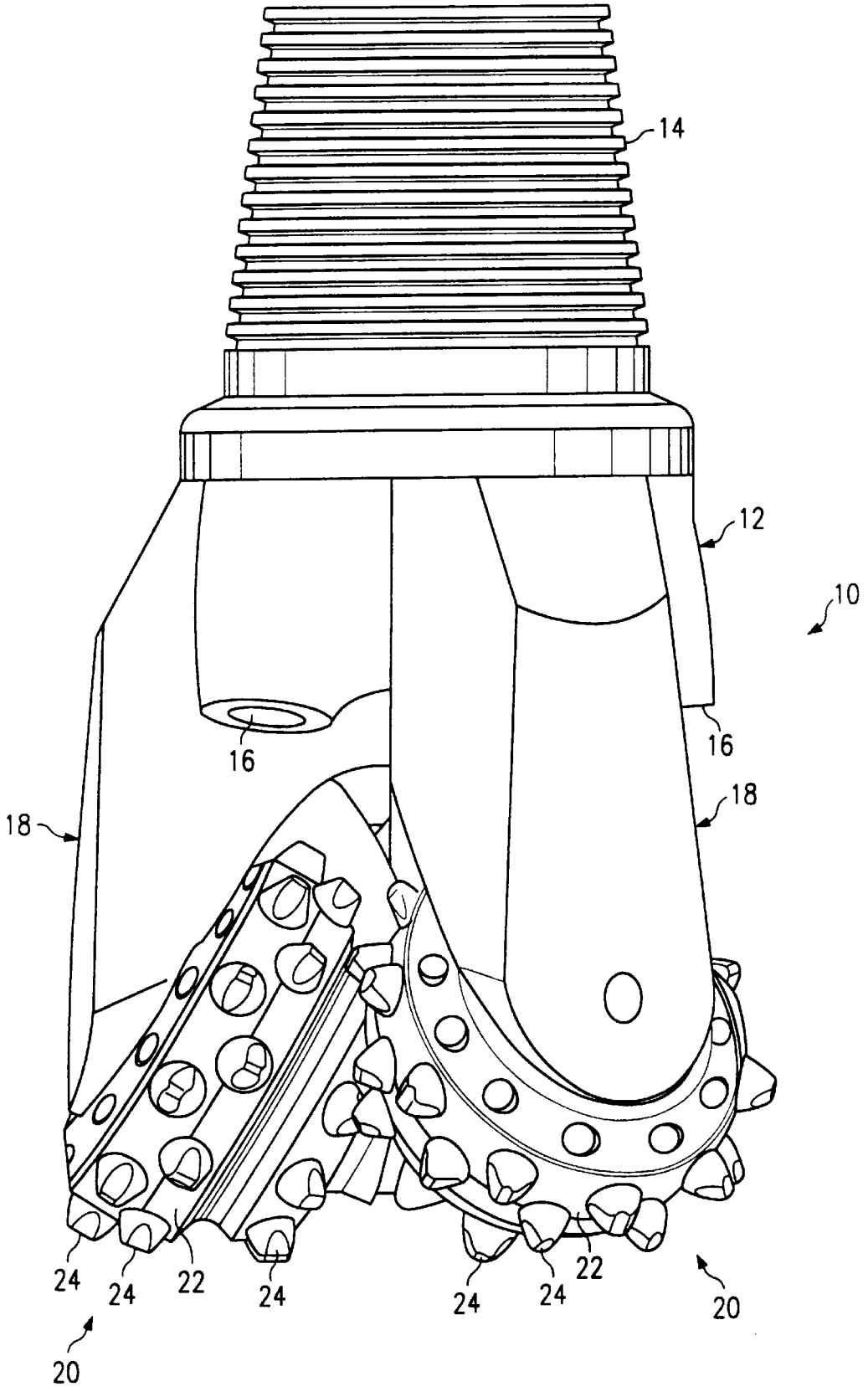
FIG. 1 is an isometric drawing of a roller cone rock bit.

FIG. 1 illustrates an isometric view of a roller cone rock bit 10. Bit 10 includes a bit body 12 adapted to be connected at a pin or threaded connection 14 to a lower end of a rotary drill string (not explicitly shown). Threaded connection 14 and the corresponding threaded connection of the drill string are designed to allow for rotation of bit 10 in response to rotation of the drill string at the well surface (not explicitly shown). Bit body 12 includes a passage (not explicitly shown) that provides downward communication for drilling mud or the like passing downwardly through the drill string. The drilling mud exits through a number of nozzles 16 and is directed to the bottom of a bore hole and then passes upward in an annulus between a wall of the bore hole and the drill string, carrying cuttings and drilling debris upward and away from the bottom of the bore hole.

Depending downwardly from bit body 12 are three substantially similar support arms 18. Each support arm 18 rotatably supports a generally conical cutter cone assembly 20. Each cutter cone assembly 20 has a defined axis of rotation about which the cutter cone assembly 20 rotates. Each cutter cone assembly 20 includes a cutter cone 22. Cutter cone 22 includes a number of inserts 24 disposed in a surface of each cutter cone 22. Each insert 24 of each cutter cone 22 is generally of the same size; however, different sizes of inserts 24 may be incorporated.

Figure 2:
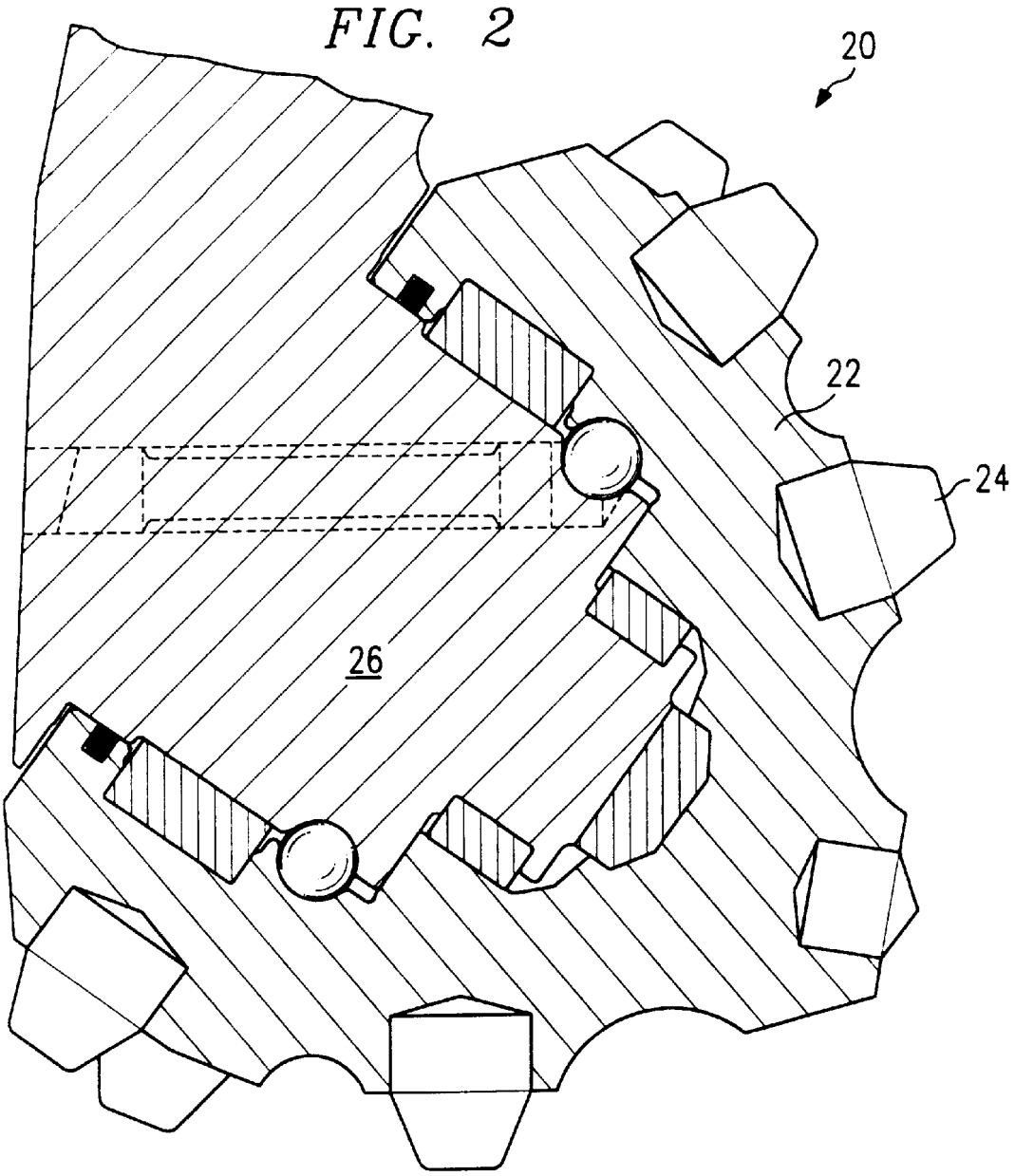
FIG. 2 is a cross sectional drawing with portions broken away of a support arm of a cutter cone assembly of the roller cone rock bit of FIG. 1.

FIG. 2 illustrates a cross sectional view of the interconnection of one cutter cone assembly 20 and associated support arm 18. Each of support arms 18 has a bearing pin or spindle 26 attached to an end of support arm 18 that is opposite bit body 12. Cutter cone 22 of each cutter cone assembly 20 is mounted on spindle 26. Cutter cone assemblies 20 may sometimes be referred to as "rotary cone cutters" or "roller cone cutters." In operation, the cutting action or drilling action of bit 10 occurs as cutter cone assemblies 20 are rolled around the bottom of the bore hole by the rotation of the drill string. Inserts 24 contact an earth formation as cutter cone assemblies 20 are rolled around the bottom of the bore hole and operate to scrape and gouge the earth formation.

Figure 3:
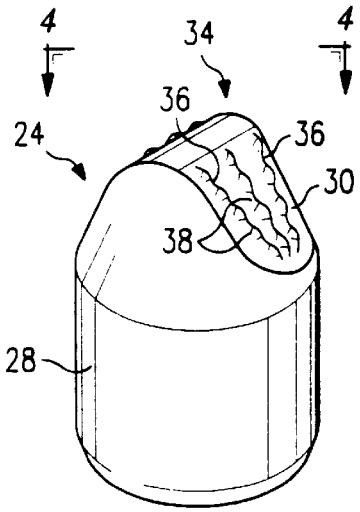
FIG. 3 is an enlarged drawing of a cutter insert constructed according to the teachings of the present invention.
Figure 4:
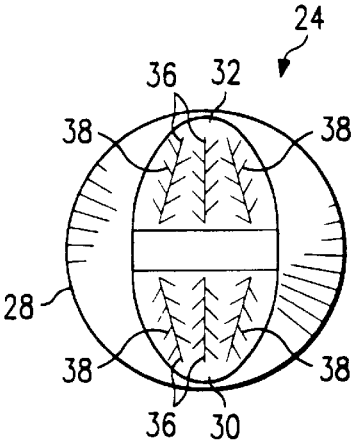
FIG. 4 is an enlarged drawing of the cutter insert of FIG. 3 taken along line 4—4 of FIG. 3.

FIGS. 3 and 4 illustrate enlarged views of insert 24 constructed according to the teachings of the present invention. As shown best in FIG. 4, insert 24 includes a stud 28 including a leading face 30 and a trailing face 32. Stud 28 may be constructed from materials such as tungsten carbide. Leading face 30 is the surface of insert 24 in the direction of rotation of cutter cone assembly 20. Stud 28 also includes a crest face 34. Crest face 34 may have a rounded shape, as shown in FIG. 3, or may be formed in other shapes including, but not limited to, planar or pointed (not explicitly shown).

Figure 5:
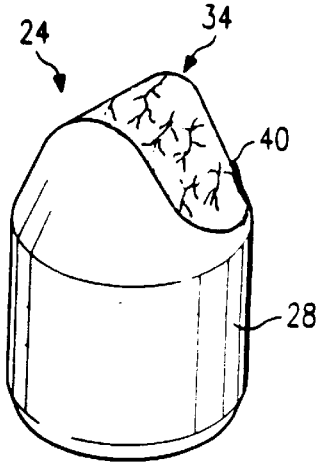
FIG. 5 is an enlarged drawing of a cutter insert constructed according to the teachings of the present invention after application of polycrystalline diamond.

FIG. 5 is an enlarged view of insert 24 constructed according to the teachings of the present invention after application of a wear resistant material to stud 28. The wear resistance of insert 24 may be improved by bonding a superhard abrasive material to certain wear areas of stud 28. This superhard abrasive material is often referred to as polycrystalline diamond, PDC, or sintered diamond and may include materials such as synthetic or natural diamond, cubic boron nitride, and wurtzite boron nitride. In accordance with an embodiment of the present invention, as shown best in FIG. 4, a number of primary tapered ridges 36 are integrally formed in leading face 30, trailing face 32, and crest face 34 of stud 28. Stud 28 also includes a number of secondary tapered ridges 38 integrally formed in leading face 30, trailing face 32, and crest face 34 extending from primary tapered ridges 36. As shown best in FIG. 5, a layer 40 of abrasive material is applied to leading face 30, trailing face 32, and crest face 34 covering primary tapered ridges 36 and secondary tapered ridges 38.

The advantages of the present invention include reducing the effect of thermally-induced interfacial shear stresses created by bonding layer 40 of abrasive material to stud 28. Superhard abrasive materials may be bonded to stud 28 at high temperatures and high pressures. Due to different coefficients of thermal expansion between the superhard abrasive material and stud 28, thermally-induced shear stresses are created at an interface between the superhard abrasive material and stud 28. Because of the shear stresses between the superhard abrasive material and stud 28, the superhard abrasive material may delaminate upon impact with an earth formation, upon heating, or upon other disturbances to stud 28.

In accordance with an embodiment of the present invention, by providing primary tapered ridges 36 and secondary tapered ridges 38 in leading face 30, trailing face 32, and crest face 34 of stud 28, thermally-induced shear stresses between layer 40 of abrasive material and stud 28 are decreased. As shown by the following equation, thermal expansion is a function of length, temperature, and a coefficient of thermal expansion for a given material:

$$\Delta L=\alpha L\Delta T$$

where L is length, $\Delta L$ is change in length, T is temperature, $\Delta T$ is change in temperature, and $\alpha$ is a coefficient of thermal expansion for a given material. Primary tapered ridges 36 and secondary tapered ridges 38 operate to reduce a bonding interface length, reflected by L in the above equation, between layer 40 of abrasive material and leading face 30, trailing face 32, and crest face 34 of stud 28. The reduction in bonding interface length between layer 40 of abrasive material and leading face 30, trailing face 32, and crest face 34 of stud 28 results in a decreased change in material length, reflected by $\Delta L$ in the above equation, of layer 40 of abrasive material and stud 28 during the high temperature and high pressure application of layer 40 of abrasive material to stud 28. The resulting decreased change in material length of layer 40 of abrasive material and stud 28 reduces the thermally-induced shear stresses that may cause delamination of layer 40 of abrasive material from stud 28. Therefore, the wear resistance of insert 24 is greater than the wear resistance of conventional inserts.

Although the embodiment of the invention described herein includes a number of primary tapered ridges 36 and secondary tapered ridges 38 in leading face 30, trailing face 32, and crest face 34 of stud 28, the number, location, taper direction, and orientation of primary tapered ridges 36 and secondary tapered ridges 38 in stud 28 may be altered while still providing the advantages described above.

Although the present invention and its advantages have been described in detail, it should be understood that various changes, substitutions, and alterations can be made therein without departing from the spirit and scope of the present invention as defined by the appended claims.

What is claimed is:

1. A cutter insert for a roller cone rock bit comprising:

a stud having at least one face, the at least one face having a primary tapered ridge and at least two secondary tapered ridges extending from separate respective points on the primary tapered ridge; and a layer of abrasive material disposed over the at least one face.

2. The cutter insert of claim 1, wherein the at least one secondary tapered ridge comprises a plurality of secondary tapered ridges extending from the primary tapered ridge.

3. The cutter insert of claim 2, wherein the primary tapered ridge comprises a height, wherein the plurality of secondary tapered ridges comprise a plurality of heights, and wherein the plurality of heights decreases as the height of the primary tapered ridge decreases.

4. The cutter insert of claim 2, wherein the plurality of secondary tapered ridges comprise a plurality of approximately uniformly spaced apart tapered ridges.

5. The cutter insert of claim 1, wherein the at least one face comprises a first face and a second face, the first face having a primary tapered ridge and at least one secondary tapered ridge extending from the primary tapered ridge in the first face, the second face having a primary tapered ridge.

6. The cutter insert of claim 5, wherein the second face comprises a secondary tapered ridge extending from the primary tapered ridge in the second face.

7. The cutter insert of claim 6, wherein the at least one secondary tapered ridge in the second face comprises a plurality of secondary tapered ridges extending from the primary tapered ridge in the second face.

8. The cutter insert of claim 5, wherein the at least one secondary tapered ridge in the first face comprises a plurality of secondary tapered ridges extending from the primary tapered ridge in the first face.

9. The cutter insert of claim 5, wherein an intersection of the first face and the second face forms a crest face, wherein the primary tapered ridge in the first face extends into the crest face.

10. The cutter insert of claim 1, wherein the layer of abrasive material comprises a uniform thickness on the at least one face.

11. The cutter insert of claim 1, wherein the primary tapered ridge comprises a rounded peak.

12. The cutter insert of claim 1, wherein the abrasive material comprises polycrystalline diamond.

13. A roller cone rock bit comprising:

a bit body;

a support arm extending from the bit body; and a cutter cone coupled to the support arm, the cutter cone having at least one cutting element comprising:

a stud having at least one face, the at least one face having a primary tapered ridge and at least two secondary tapered ridges extending from separate respective points on the primary tapered ridge; and a layer of abrasive material disposed over the at least one face.

14. A method for fabricating a cutting element for a roller cone rock bit comprising the steps of:

providing a stud having at least one face, the at least one face having a primary tapered ridge and at least two secondary tapered ridges extending from separate respective points on the primary tapered ridge; and applying a layer of abrasive material over the at least one face.

15. A compact for a roller cone rock bit comprising:

first and second faces which are generally opposite to each other;

a plurality of primary ridges on said first and second faces;

a plurality of secondary ridges, extending from multiple points on the respective crests of said primary ridges; and a layer of abrasive material disposed over said first and second faces.

* * * * *